US007341695B1

(12) United States Patent
Garner

(10) Patent No.: US 7,341,695 B1
(45) Date of Patent: Mar. 11, 2008

(54) ANTI-FOULING APPARATUS AND METHOD

(76) Inventor: Stuart Garner, 3605 Murillo Cir., Austin, TX (US) 78703

( * ) Notice: Subject to any disclaimer, the term of this patent is extended or adjusted under 35 U.S.C. 154(b) by 967 days.

(21) Appl. No.: 10/737,442

(22) Filed: Dec. 16, 2003

(51) Int. Cl.
*B01L 3/00* (2006.01)
*B08B 17/02* (2006.01)

(52) U.S. Cl. ..... 422/99; 15/34; 15/38; 15/21.1; 15/308; 15/309; 422/6; 422/24

(58) Field of Classification Search ..... 422/6, 422/20, 24, 82.05, 99; 436/49; 15/308–309, 15/21.1, 34, 38
See application file for complete search history.

(56) References Cited

U.S. PATENT DOCUMENTS 5,383,776 A * 1/1995 Trail et al. ..... 425/135
5,779,909 A * 7/1998 Tomita et al. ..... 210/712
5,800,625 A * 9/1998 Engelsberg et al. ..... 134/1
6,048,588 A * 4/2000 Engelsberg ..... 427/554
6,379,746 B1 * 4/2002 Birch et al. ..... 427/154
2003/0010283 A1 * 1/2003 Yamazaki et al. ..... 118/56
2003/0094185 A1 * 5/2003 Osada et al. ..... 134/1
2004/0244138 A1 * 12/2004 Taylor et al. ..... 15/319
2006/0192484 A1 * 8/2006 Seo et al. ..... 313/504

* cited by examiner

*Primary Examiner*—Brian R. Gordon
(74) *Attorney, Agent, or Firm*—J. Nevin Shaffer, Jr.

(57) ABSTRACT

An anti-fouling apparatus and method includes a configurable cleaner connected to an object for physically removing foulants on the object. A UV light device is connected to the object for preventing the growth of foulants on the object and a camera is connected to the object for observing the presence of foulants on the object. The configurable cleaner removes foulants from the object as well as the UV light and the camera.

25 Claims, 2 Drawing Sheets

ANTI-FOULING APPARATUS AND METHOD

FIELD OF THE INVENTION

This invention relates to an anti-fouling apparatus and method. In particular, this invention relates to an anti-fouling apparatus and method for removing foulants from an object and for preventing the growth and/or accumulation of foulants on an object.

BACKGROUND OF THE INVENTION

A difficulty arises whenever instruments are utilized to measure anything. It has been said that no perfect measurement may ever be made for the reason that the very act of measuring the thing changes it. Needless to say, despite the fact that this is very often if not always true, in most circumstances that degree of precision is not warranted and any errors due to the act of measuring itself are well within acceptable limits for error. On the other hand, it is necessary for instruments to remain functioning at the highest possible levels for as long as possible for obvious reasons. Instruments which cease to function accurately within accepted limits after only short periods of use increase demands on the user's resources of time and money.

Methods for extending the operational time of instruments using sensors for taking measurements in various situations have long been sought. Many such sensors, including sensors for measuring temperature, dissolved oxygen, pH, gas constituencies, conductivity, turbidity, flow, color, biological activity, specific ionic activity, pressure, and oxidation-reduction potential, for example only, are designed to operate when immersed in fluids, including air and water. Often, such sensors are continuously and progressively degraded by the fluids within which they are immersed (perhaps by the very analytes for which the sensors are designed) such that the instruments cease to accurately measure that which they are calibrated to do. This is called "sensor drift" and might be caused by the nature of the sensor, its maintenance condition or by sensor fouling.

For the purposes of example only, and not by limitation, the purposes for such measurements and the need for such measuring instruments vary from environmental protection to process control to scientific research to hydrologic monitoring in surface waters (including lakes, rivers, and estuaries), ground waters (including aquifers and water tables), and waters in control structures (including pipes, channels, and tanks). Sensor drift is a debilitating and expensive problem affecting sensors and sensor drift caused by fouling is of particular concern. Fouling occurs when materials in the water(foulants) attach themselves to, and/or grow upon, a sensor to such an extent that the accuracy of the measurement deteriorates. Foulants include algae, bacterial slimes, fungi, oils, greases, grit, biological solids, or industrial by products such as paper fibers. Such fouling can render the sensor inoperable, or even worse, allow subtle errors to contaminate a data set and cause erroneous data analysis. Either way, the purpose of the sensors—accurate and timely data at a reasonable cost-is negated. Critical data is lost, and sensor operation and maintenance costs must increase to prevent additional data loss.

By way of example only, and not by limitation, many environmental, academic, and economic decisions require water-quality data. Some practitioners prefer to gather their water-quality data in situ, meaning that the pertinent water-quality sensors must be immersed in the water to be analyzed. Often, however, the water to be analyzed contains biological and mechanical, living and inert, contaminants that can accumulate and/or grow on the surface of the sensors, causing the sensors' calibrations to drift, and possibly rendering the data useless or subtly misleading. Practitioners often prefer to use multiple sensors in their investigations, so that a full set of data is gathered as quickly and inexpensively as possible. Instruments employing more than one sensor are called "multiprobes". When multiprobes are deployed in waters containing foulants, the sensors will eventually become contaminated/fouled.

A variety of prior art attempts have been made to solve the problem of sensor fouling. When sensors are deployed without protection against fouling they can only be deployed in fouling conditions for short periods. This means that the frequency, and therefore the cost and safety risk, of retrieving, maintaining, and recalibrating the sensors is maximized. Solutions include mechanical devices such as shutters to shield the sensor from the fouling media as much as possible. Other devices include chemical means such as anti fouling paints, biocidal coatings, construction materials unfriendly to micro biota, and even electric fields to prevent the deposition and/or growth of biological foulants. Other sensors utilize other mechanical devices, such as compressed air or ultrasonic cleaners, to remove accumulated foulants. Problematically, these prior art mechanical devices are difficult to apply to multiple sensors of different sizes and shapes, raise the price and complexity of individual sensors, complicate calibration, maintenance, repair, and operation even in non-fouling situations, and often suffer from high power consumption and poor control.

So-called chemical solutions in use to date as a means to prevent the deposition and/or growth of biological foulants have little or no effect on non-biological foulants, including oils and sedtiments. For example only, prior art devices utilizing biocidal coatings are incapable of preventing foreign materials from accumulating in the vicinity of the sensor or doing anything about an inert film, such as oil, that prevents accurate operation of the sensor just as much as any living material. A similar problem exists with conventional optical sensors in that they can become contaminated by materials in the fluid, such as a algae in biologically active waters or sediment in industrial process waters. This problem is complicated by the fact that the optical sensor may be only slightly altered and cause the operator to accept errant or misleading data or draw erroneous conclusions.

SUMMARY OF THE INVENTION

The anti-fouling apparatus and method of the present invention includes, according to one embodiment, a configurable cleaner connected to an object for physically removing foulants on the object. An ultraviolet (UV) light is connected to the object for reducing the growth of biological foulants on the object. The camera is connected to the object or sensors for observing the presence of foulants on the object and a configurable cleaner removes foulants from the UV light and the camera as well as from the object and/or sensors.

According to other aspects of the invention, a plurality of cleaning devices is provided. In one aspect, which one of the plurality of cleaning devices physically removes foulants from the object depends on the direction of movement of the configurable cleaner. According to another aspect, the plurality of cleaning devices is selected from a group of cleaning devices including brushes, squeegees, chamois, ultrasound and compressed gas. In accordance with a further aspect of the invention, the configurable cleaner includes a first set of cleaning devices with a first set of characteristics and a second set of cleaning devices with a second set of characteristics. According to one aspect, the first set of cleaning devices physically removes foulants from the object when a configurable cleaner is moved in one direction and th second set of cleaning devices physically removes foulants from the object when the same configurable cleaner is moved in another direction.

According to other aspects of the invention, a spacer plate is provided. In accordance with a further aspect of the invention, the camera is directed to sensors on the object and, in another aspect, the camera is directed to a proxy surface at the object. In accordance with a further aspect, the camera monitors a light source as it is reflected from the proxy surface. According to one aspect, an opaque cover is attached to the object.

According to a further aspect of the invention, a control device is attached to the object for controlling the operation of the apparatus. According to a further aspect, the control device receives input from the camera and controls the operation of the apparatus with controls selected from a group including duration of operation, direction of movement and speed of movement.

DETAILED DESCRIPTION OF THE INVENTION

Figure 1:
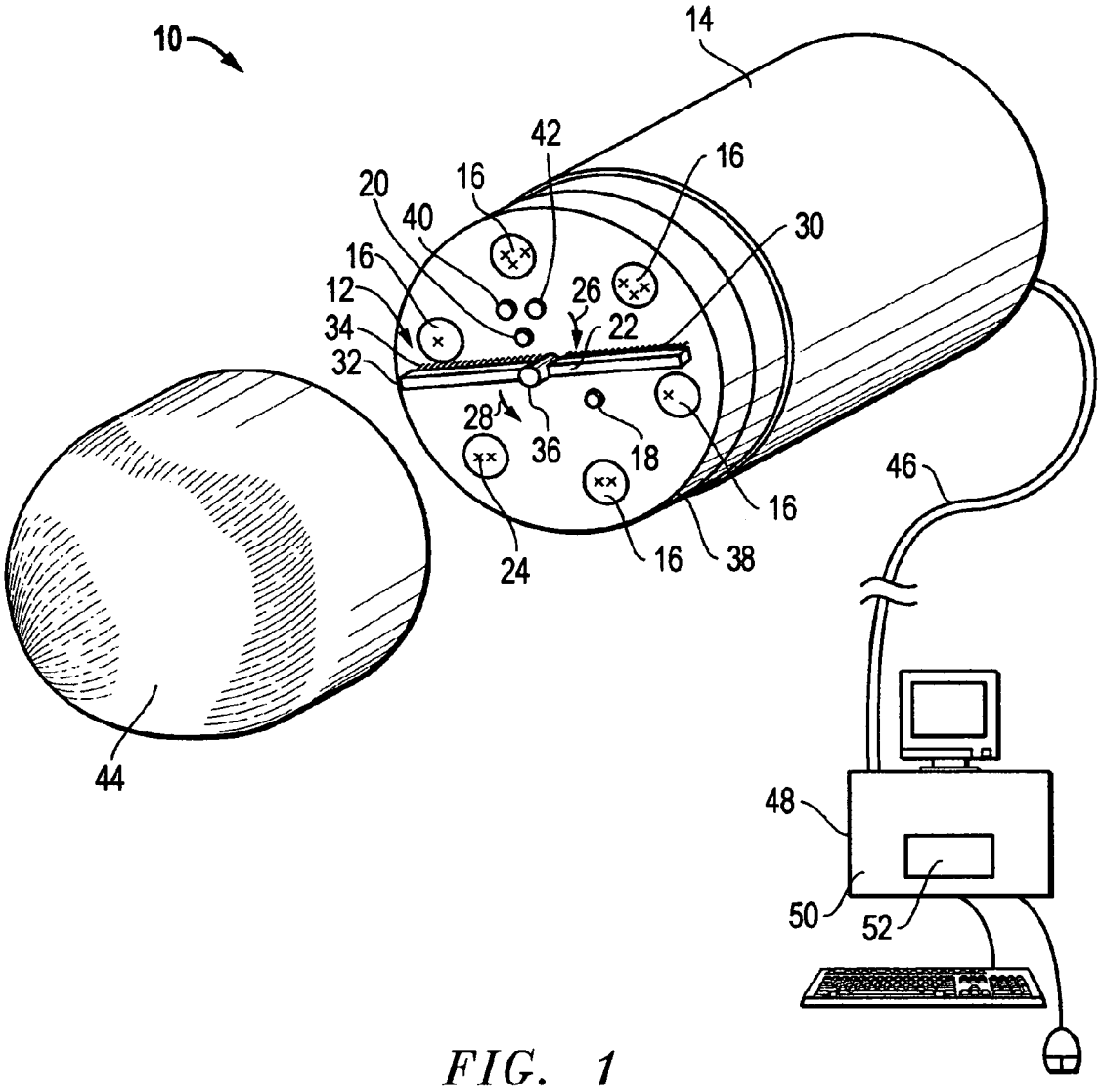
FIG. 1 is a perspective view of the anti-fouling apparatus according to one embodiment of the present invention.
Figure 2:
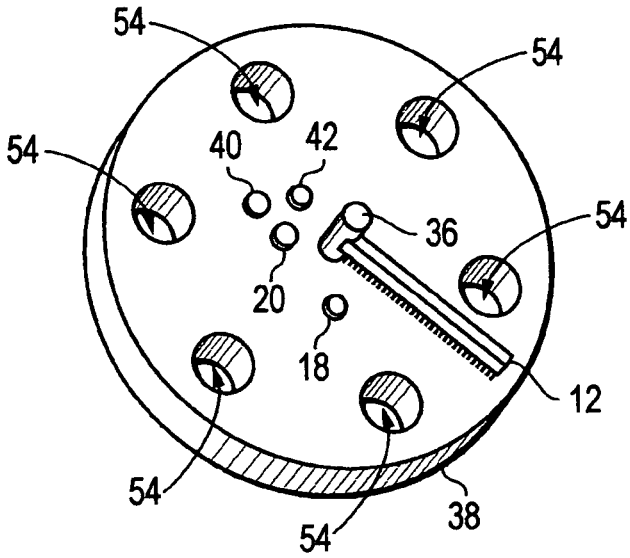
FIG. 2 is a perspective view of a spacer plate with attached configurable cleaner according to the embodiment of FIG. 1.
Figure 3:
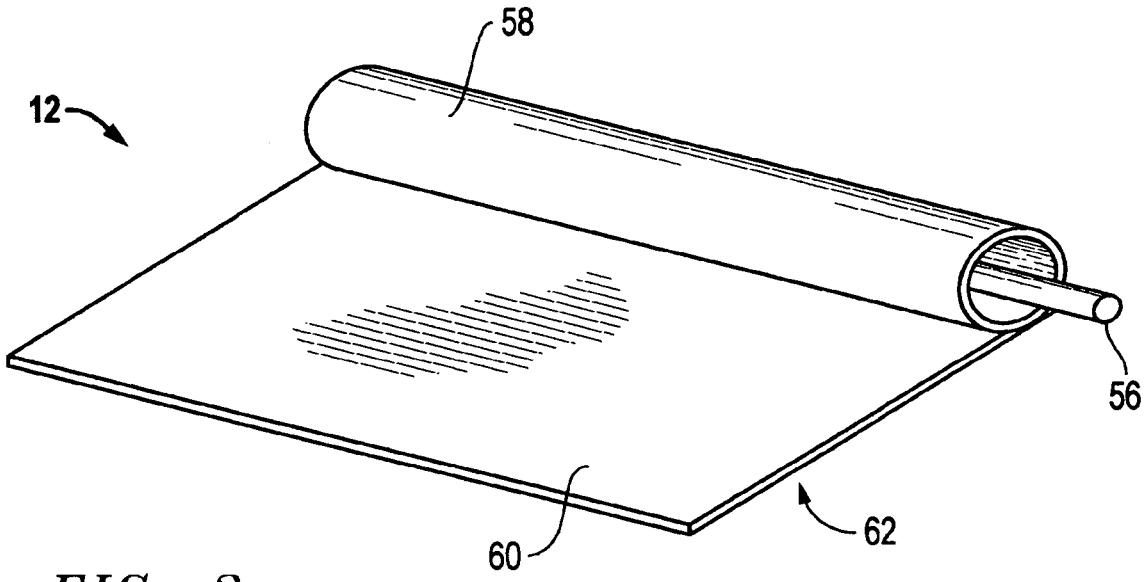
FIG. 3 is a perspective view of the configurable brush according to the embodiment of FIG. 1.

An embodiment of the present invention is illustrated by way of example in FIGS. 1-3. With specific reference to FIG. 1, anti-fouling apparatus 10, according to one embodiment of the present invention, includes a configurable cleaner 12 attached to an object 14. For the purposes of example only, and not by way of limitation, object 14 is represented as a multiprobe sensor device. As illustrated, object 14 includes many sensors 16. Sensors 16, as that term is used herein, an includes sensors for measuring temperature, dissolved oxygen, pH, gas constituencies, conductivity, turbidity, flow, color, biological activity, specific ionic activity, pressure, and oxidation-reduction potential, for example only. Any sensors 16 now known or hereafter developed are accommodated by the current invention. A UV light 18 and a camera 20 are connected to object 14. According to this aspect of the invention, configurable cleaner 12 is conformed to remove foulants from sensors 16, UV light 18, and camera 20, as will be more fully disclosed hereafter.

According to one aspect of the invention, configurable cleaner 12 includes a plurality of cleaning devices 22. According to another aspect of the invention, which one of the plurality of cleaning devices 22 physically removes foulants 24 (represented by "x's" in the figures) depends on the direction of movement of the configurable cleaner 12. That is, according to this aspect of the invention, one set of cleaning devices 22 removes foulants 24 when moving in the direction of direction arrow 26 and another set of cleaning devices 22 removes foulants 24 when moving in the direction of direction arrow 28.

According to one aspect of the invention, the plurality of cleaning devices 22 is selected from a group of cleaning devices including brushes 30, ultrasound 32 and compressed gas 34. Brushes 30 may be any brushes now known or hereafter developed. Ultrasound 32 includes any ultrasound producing device now known or hereafter developed. Compressed gas 34 may be any type of compressed gas, such as air, as found appropriate for the circumstance. According to this aspect of the invention, as illustrated in FIG. 1, a pair of cleaning devices 22 is attached to a drive shaft 36. When drive shaft 36 rotates in the direction of direction arrow 26, brushes 30 are brought in contact with sensors 16, UV light 18, and camera 20. According to one aspect of the invention, when drive shaft 36 rotates in the direction of direction arrow 28, the cleaning arm 56 pivots and a different type of brush, or an alternative cleaning device such as ultrasound 32 and compressed gas 34, are directed to sensors 16, UV light 18, and camera 20. As a result, heavy buildups of foulants 24 on sensors 16, UV light 18, and camera 20 are initially primarily removed by brushes 30 rotating in the direction of direction arrow 26. Thereafter, by rotating cleaning devices 22 in the opposite direction, the different type of brush or additional cleaning devices 22, such as, for example only, ultrasound 32 and compressed gas 34, are directed to sensors 16, UV light 18, and camera 20 so as to completely remove foulants 20 therefrom. By way of example only, a first type of brush may be a very stiff brush for removing heavy buildup of foulants. The second type of brush may be much less stiff when only small, easily removed amounts of foulants have accumulated on the sensors, camera lens and so forth.

According to another aspect of the invention, a spacer plate 38 is provided. Spacer plate 38 is conformed to surround sensors 16, UV light 18, and camera 20 so as to greatly diminish the surface area exposed to foulants 24. Without spacer plate 38, a very much larger surface area of sensors 16, UV light 18 and camera 20 are exposed to foulants.

According to one aspect of the invention, as described above, camera 20 is directed to sensors 16 on object 14. According to another embodiment of the invention, camera 20 is directed to a proxy surface 40. Proxy surface 40 serves as a collection place for foulants 24 representative of the amount and type of foulants 24 likely to be collected on sensors 16, UV light 18, and camera 20 themselves. As a result of observing proxy surface 40, the user can estimate the amount of foulants 24 actually on sensors 16, UV light 18, and camera 20, for example. According to another aspect of the invention, camera 20 monitors a LED light source 42 directing light on to the protected, unfouled side of the transparent proxy surface 40. According to this aspect, camera 20, mounted inside object 14, monitors the LED light source 42 as it is reflected from the proxy surface 40 such that an estimate of the amount of foulants 24 present on sensors 16, UV light 18, and camera 20 may be made.

According to another aspect of the invention, an opaque cover of 44 is provided. Opaque cover 44 is conformed to attach to object 14 so as to protect sensors 16, UV light 18 and camera 20 and to reduce fouling by blocking sunlight and by reducing the volume of foulants, contained in the medium in the within which object 14 is immersed, that come in contact with sensors 16, camera 20, and especially UV light 18.

Object 14 is connected to remote monitoring devices as is known in the art either by a direct physical connection 46, such as an electrical cord for example only, or remotely, all as is known in the art and not disclosed or described more fully hereafter. According to one aspect of the invention, however, object 14, sensors 16, UV light 18 and camera 20, are connected to control device 48. Control device 48 is provided for controlling the operation of anti-fouling apparatus 10. According to one aspect of the invention, control device 48 receives input from camera 20 and controls the operation of anti-fouling apparatus 10 with controls selected from a group including duration of operation, direction of movement and speed of movement of configurable cleaner 12. Obviously, control device 48 may be any control device now known or hereafter developed for receiving information from anti-fouling apparatus 10 and directing the operation thereof. According to one aspect of the invention, control device 48 includes a computer processing unit 50 and a computer program product 52 including instructions for controlling the operation of anti-fouling apparatus 10.

Referring now to FIG. 2, configurable cleaner 12 is shown attached to drive shaft 36 and removably attachable spacer plate 38. According to this embodiment, drive shaft 36 connects to a connection of a drive shaft mounted in object 14, and to a motor or solenoid located within object 14 or remotely, as previously illustrated in FIG. 1. As illustrated in this embodiment, only a single configurable cleaner 12 is attached to drive shaft 36 as opposed to the two shown in FIG. 1. Obviously, any useful number, one or more, may be used.

FIG. 2 illustrates spaces 54 conformed to receive sensors 16 but, for clarity, not the spaces for UV light 18, camera 20, proxy surface 40 or LED light source 42. As illustrated, the single, extended, configurable cleaner 12 includes cleaning devices 22 as previously discussed. As clearly illustrated in FIG. 2, cleaning devices 22 are attached to cleaning arm 56. Cleaning arm 56 is connected to drive shaft 36. When rotated in one direction, cleaning arm 56 swivels and brings one set of cleaning devices 22 in contact with sensors 16, and so forth as disclosed above. When rotated in another direction, cleaning arm 56 swivels and brings another set of cleaning devices 22 in contact with sensors 16.

Referring now to FIG. 3, another aspect of the invention is illustrated wherein cleaning arm 56 is surrounded by swivel 58. Cleaning devices 22 are connected to both sides of swivel 58. As result, cleaning devices 22 include a first side 60 and a second side 62. Again, in accordance with the invention, first side 60 engages object 14 when rotated in one direction and second side 62 engages object 14 when rotated in the opposite direction as enabled by swivel 58. First side 60 may include one type of medium such as stiff brushes, for example only. Second side 62 may include a second medium such as soft bristles, silicone squeegee, chamois, or the like. By controlling the direction of rotation of configurable cleaner 12, different mediums (or the same medium with a different pressure exerted on the objects to be cleaned) are brought in contact with object 14 and in the order in which the user deems most efficient and useful.

By way of further explanation, anti-fouling apparatus and method 10 of the present invention is connected to, or located in part within, object 14. According to one aspect of the invention, again, object 14 is a multiprobe device for measuring attributes of a particular medium. One preferred medium is water but any medium containing foulants 24 is encompassed within the scope of the present invention. An additional obvious medium is air or other gases, for example only. In any event, object 14 includes a housing shielding the sensitive parts of sensors 16, UV light 18, camera 20, drive shaft 36, and the like, from contact with the medium. Additionally, the housing of object 14 contains any other operational mechanisms desired such as a motor, battery, and the like.

In operation, drive shaft 36 engages configurable cleaner 12 and moves configurable cleaner 12 in one direction or another as desired by the user. According to the invention, configurable cleaner 12 includes multiple cleaning devices 22 such as, for example only, brushes 30, ultrasound 32 and compressed gas 34. Depending on the direction of operation of configurable cleaner 12 by drive shaft 36, a desired cleaning device 22 is brought in contact with sensors 16 and so forth.

Camera 20 may be directed directly at sensors 16 or may be directed at a proxy surface 40. Further, camera 20 may be directed at observing light reflected from proxy surface 40 from an LED light source. By way of a means for further protecting sensors 16, and so forth, from foulants 24 a spacer plate 38 may be added to objects 14. According to one aspect, when configurable cleaner 12 is connected to spacer plate 38, spacer plate 38 and configurable cleaner 12 may be removed and replaced without interfering with, or requiring the removal of, sensors 16 or any of the other of elements of the invention.

Camera 20 may be used manually or automatically to observe foulants 24. For example only, when camera 20 observes reflected light from proxy surface 40, a computer program may be utilized to engage configurable cleaner 12 whenever the reflected light reaches a minimum as set by the user. Obviously, anti-fouling apparatus and method 10 may include a simple mechanical control for turning configurable cleaner 12 on at a preset interval.

According to the anti-fouling apparatus and method 10 of the present invention, configurable cleaner 12 is not connected to or related with any of the sensors 16. That is to say, configurable cleaner 12 is operated independent of sensors 16 and can bring to bear a much more robust cleaning effort to sensors 16 than has previously existed. Other elements of the invention may include an optical sensor fitted to the motor so that the exact rotational position of drive shaft 36 is known. An optical sensor would allow the user to control the rotational speed of the configurable cleaner 12 and to allow the user to ensure that the configurable cleaner 12 is not left in a position that obscures or restricts the function of sensors 16, the UV light 18, etc.

Other items to be kept in mind in the creation of the anti-fouling apparatus and method 10 of the present invention are that the sensors 16, and other elements of the invention, must be located along, or within, the same plane for cleaning purposes. Additionally, some sensors 16 may be so delicate as to need to be recessed slightly within spacer plate 38 such that only some of the cleaning devices 22 may be brought to bear.

With regard to the term "ultraviolet light" used herein, the ultraviolet light 18 can be any source of radiant energy in the ultraviolet band that discourages biological activity. Examples include fluorescent lamps and light emitting diodes (LEDs). The needed power supply is any electrical source capable of powering the ultraviolet light 18 to the energy level needed to discourage biological activity. The housing of objects 14 as disclosed above protects and contains any of the ultraviolet light 18 mechanisms sensitive to contamination by foulants, such as water, for example only.

With regard to the camera 20 of the present invention, camera 20 includes any camera now known or hereafter developed, and the elements needed to function, such as a small optical camera or similar device, such as a CCD-type photo receiver, a light source (such as a photodiode) and photo detector separated from the contaminated fluid, or other medium within which object 14 is located, by a transparent or translucent lens or glass. In use the photodiode or other light source, such as a flash tube, illuminates the surfaces of sensors 16 monitored by the camera. A lens may protect the camera, and other operational elements, from the environment. Obviously, it is necessary that the light source be powerful enough to illuminate any contaminants on the sensors 16. Ultrasound, x-ray type radiation, heat, and so forth, are examples of energies that can be used in place of light. In sum, however, camera 20 records the appearance of the sensors 16 so that the operator can judge whether or not the sensors 16 as likely to be operable. A light provides illumination for the camera 20 and configurable cleaner 12 keeps the shielding lens of the light source and camera clean.

The description of the present embodiments of the invention has been presented for purposes of illustration but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An anti-fouling apparatus comprising:

a) an object;

b) a configurable cleaner means, for physically removing foulants on said object, connected to said object;

c) a UV light means, for preventing the growth of foulants on said object, connected to said object; and d) a camera means, for observing the presence of foulants on said object, connected to said object;

e) wherein said configurable cleaner means also removes foulants from said UV light means and said camera means.

2. The apparatus of claim 1 wherein said configurable cleaner means further comprises a plurality of cleaning devices.

3. The apparatus of claim 2 wherein said configurable cleaner means is moveable and one of said plurality of cleaning devices ability to physically removes foulants from said object depends on the directional of movement of the configurable cleaner means.

4. The apparatus of claim 2 wherein said plurality of cleaning devices is selected from a group of cleaning devices including: brushes, silicone squeege, chamois, ultrasound and compressed gas.

5. The apparatus of claim 1 wherein said configurable cleaner means further comprises a first set of cleaning devices with a first set of characteristics and a second set of cleaning devices with a second set of characteristics.

6. The apparatus of claim 5 wherein said first set of cleaning devices physically removes foulants from said object, UV light means and camera means when said configurable cleaner means is moved in one direction and wherein said second set of cleaning devices physically removes foulants from said object, UV light means and camera means when said configurable cleaner means is moved in another direction.

7. The apparatus of claim 1 wherein said object further includes a spacer plate.

8. The apparatus of claim 1 wherein said object comprises sensors and said camera means directed to said sensors on said object.

9. The apparatus of claim 1 wherein said object comprises a proxy surface said camera means directed to a said proxy surface at said object.

10. The apparatus of claim 9 further comprising a LED light-source, wherein said camera means monitors said LED light source as it is reflected from said proxy surface.

11. The apparatus of claim 1 further comprising an opaque cover attached to said object.

12. The apparatus of claim 1 further comprising a control means for controlling the operation of the apparatus.

13. The apparatus of claim 12 wherein the control means receives input from said camera means and controls the operation of the apparatus with controls selected from a group including duration of operation, direction of movement and speed of movement.

14. For an object immersed in a fluid, an anti-fouling apparatus for removing fouling from and preventing fouling of said object, the apparatus comprising:

a) an object;

b) a configurable brush, for physically removing foulants on said object, connected to said object;

c) a UV light, for preventing the growth of foulants on said object, connected to said object; and d) a camera, for observing the presence of foulants on said object, connected to said object;

e) wherein said configurable brush also removes foulants from said UV light and said camera.

15. The apparatus of claim 14 wherein said configurable brush further comprises a plurality of cleaning devices.

16. The apparatus of claim 15 wherein said configurable brush is moveable and one of said plurality of cleaning devices ability to physically removes foulants from said object depends on the directional of movement of the configurable brush.

17. The apparatus of claim 15 wherein said plurality of cleaning devices is selected from a group of cleaning devices including: brushes, silicone squeege, chamois, ultrasound and compressed gas.

18. The apparatus of claim 14 wherein said configurable brush further comprises a first brush with a first set of characteristics and a second brush with a second set of characteristics.

19. The apparatus of claim 18 wherein said first brush physically removes foulants from said object when said configurable brush is moved in one direction and wherein said second brush physically removes foulants from said object when said configurable brush is moved in another direction.

20. The apparatus of claim 14 wherein said object further comprises a movable, removable brush plate to which said configurable brush is attached.

21. The apparatus of claim 14 further comprising a control device wherein the control device receives input form the camera and controls the operation of the apparatus with controls selected from a group including duration of operation, direction of movement and speed of movement.

22. The apparatus of claim 21 wherein said control device is a computer program product including instructions for controlling the operation of the apparatus.

23. The apparatus of claim 14 further comprising a spacer plate for covering portions of said object.

24. For an object immersed in a fluid, an anti-fouling method for removing fouling from and preventing fouling of said object, the method comprising the steps of:

a) connecting a configurable cleaning device to an object for physically removing foulants on said object;

b) connecting a UV light, for preventing the growth of foulants on said object, to said object;

c) connecting a camera, for observing the presence of foulants on said object, to said object;

d) operating said camera to observe the presence of foulants on said object;

e) operating said configurable cleaning device to remove observed foulants on said object;

f) operating said UV light to prevent the growth of foulants on said object; and g) operating said configurable cleaning device to remove foulants from said UV light and said camera.

25. The method of claim 24 further comprising the steps of:

a) providing a first set of cleaning devices with a first set of characteristics and a second set of cleaning devices with a second set of characteristics; and b) moving said first set of cleaning devices in one direction so as to physically remove foulants from said object, UV light and camera with said first set of cleaning devices and moving said second set of cleaning devices in another direction so as to physically remove foulants from said object, UV light and camera with said second set of cleaning devices.

* * * * *